US007587996B2

(12) United States Patent
Albrecht

(10) Patent No.: US 7,587,996 B2
(45) Date of Patent: Sep. 15, 2009

(54) CIRCULATION SYSTEM FOR SLIDING PRESSURE STEAM GENERATOR

(75) Inventor: Melvin J. Albrecht, Homeworth, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 292 days.

(21) Appl. No.: 11/448,648

(22) Filed: Jun. 7, 2006

(65) Prior Publication Data

US 2007/0283906 A1 Dec. 13, 2007

(51) Int. Cl.
*F22D 7/00* (2006.01)

(52) U.S. Cl. ..... 122/406.1; 122/406.3; 122/1 B; 122/488

(58) Field of Classification Search ..... 122/406.1, 122/1 C, 1 B, 406.3, 408.1, 411, 488, 489, 122/451 R See application file for complete search history.

(56) References Cited

U.S. PATENT DOCUMENTS 4,194,468 A * 3/1980 Augsburger ..... 122/406.5
4,262,636 A * 4/1981 Augsburger ..... 122/406.5
4,290,389 A * 9/1981 Palchik ..... 122/406.4
4,520,762 A * 6/1985 Martin ..... 122/406.5
5,390,631 A * 2/1995 Albrecht ..... 122/235.12
5,713,311 A * 2/1998 Fitzgerald ..... 122/406.5
6,336,429 B1 * 1/2002 Wiener et al. ..... 122/488

* cited by examiner

*Primary Examiner*—Gregory A Wilson
(74) *Attorney, Agent, or Firm*—Michael J. Seymour; Eric Marich

(57) ABSTRACT

A steam generator circulation system is provided and includes a boiler feed pump for forcing water through an economizer, and through the waterwall tubes of an evaporator. A separator receives a mixture of steam and water and sends the steam to a steam utilization unit such as a superheater. A valve is provided below the separator. If the valve is open, the saturated water from the separator is mixed with feedwater and recirculated through the tubes of the evaporator. If the valve is closed, recirculation is terminated. At loads below the critical point, the valve below the separator system would be open and the boiler would operate like a natural circulation drum boiler. At loads above the critical point, the valve below the separator system would be closed resulting in a boiler that operates like a once-through boiler.

19 Claims, 7 Drawing Sheets

CIRCULATION SYSTEM FOR SLIDING PRESSURE STEAM GENERATOR

FIELD AND BACKGROUND OF THE INVENTION

The present invention relates generally to the field of steam generators and in particular to a new and useful circulation system for sliding pressure steam generators.

The design of once-through boilers has been around since 1926. The design of the once-through boiler was developed by Siemens on the basis of ideas that were proposed by Mark Benson. The Benson boiler introduced the concept of sliding pressure operation for a supercritical steam pressure design (e.g., to accommodate supercritical steam pressure). In the Benson design, the boiler feed pump provides the entire driving head to force the water through the economizer, evaporator, and superheater. Water is continuously evaporated to dryness and then superheated without any steam-water separation. The circulation method is applicable to all operating pressures both supercritical and subcritical. Typically, most applications of the Benson design use spiral furnace circuitry for the evaporator due to the fact that a vertical tube evaporator design is more sensitive to upsets and nonuniform tube-to-tube heating. For start-up and low load operation, special by-pass systems are needed.

In one example shown in FIG. 1, a boiler feed pump 908 for the system 910 provides the entire driving head to force the water through an economizer 911, an evaporator 912, and a superheater 914 which can be used in conjunction with a separator 913. Water is continuously evaporated to dryness and then superheated without any steam-water separation. This circulation method is applicable to all operating pressures, i.e. supercritical (greater than 3208 psia) and subcritical (less than 3208 psia). Typically, the system 910 uses spiral furnace circuitry for the evaporator 912 because a vertical tube design is more sensitive to upsets and nonuniform tube-to-tube heating. For start-up and low load operation, special by-pass systems are still needed.

In overcoming start-up and low load operation, many boiler manufacturers have developed once-through boiler designs with superimposed recirculation systems 910*a* and 910*b* illustrated in FIGS. 2 and 3. These recirculation systems permit partial recirculation of fluid to the furnace walls in order to increase the fluid velocity in the evaporator tubes by incorporating circulation pumps 915 and orifices 916. The design in many applications allows the furnace 912 to remain at constant pressure, typically supercritical pressure, and utilizes a separator or flash tank 913 for reducing the superheater pressure to subcritical pressures at start-up and low loads. These types of once-through boiler systems 910*a* and 910*b* typically utilize a vertical furnace tube evaporator design.

Examples of these types of units are B&W's Universal Pressure (UP) boiler, CE's Combined Circulation boiler and Foster Wheeler's Multipass boiler. These boilers permit partial recirculation of fluid to the furnace walls to increase the fluid velocity in the evaporator tubes. The design in many applications allows for the furnace to remain at constant pressure typically supercritical pressures and utilizes a separator or flash tank for reducing the superheater pressure to subcritical pressures at start-up and low loads. This type of once-through boiler typically utilizes a vertical furnace tube evaporator design.

Once-through boiler designs that utilize both spiral and vertical tube furnace evaporators have been sold by many boiler manufacturers, and developed for either supercritical or subcritical steam pressures. Vertical tube once-through boilers for sliding pressure applications are becoming more accepted in the industry. The sliding pressure operation of the vertical tube once-through boiler is restricted to specific minimum load due to the flow requirements of the evaporator. The spiral tube furnace does not have this restriction. The spiral furnace permits greater freedom in matching the tube diameter and mass velocity of the furnace to ensure tube cooling and flow stability in the parallel furnace evaporator tubes. It also allows each tube of the furnace to run through the various heat zones in the combustion chamber, so that difference in total heat input between tubes will be kept to a minimum.

The development of a vertical tube sliding pressure once-through boiler is needed due to the higher cost of the spiral furnace design when compared to a vertical furnace design. The construction of a forced circulation once-through boiler requires the use of a very large number of parallel tubes, welded together to form membrane panels. A fundamental requirement for membrane wall integrity is uniform fluid and metal temperature in all tubes at each furnace level. Until now, the major problem with the vertical tube design was due to the large heating difference between individual tubes in the furnace. In vertical tube furnaces the heating difference between tubes is approximately 2.5 times as great as in spiral furnace design. Average mass velocities of 1,500,000 to 2,000,000 lb/hr-ft2 are typical velocities used in current once-through boiler designs. These mass velocities when subjected to typical peripheral furnace heat absorption variations (which can vary +/−35% or more from average) result in a velocity variation that decreases in magnitude with increasing heat input. This trend is called the once-through characteristic of a boiler tube. In the once-through mode, the velocity change due to an increase in heat is negative as shown in FIG. 4**. In the event of excessive heat input to a single tube, a reduction in mass velocity occurs, causing an additional increase in the outlet temperature of the tube.

U.S. Pat. No. 5,390,631 teaches the use of Multi-Lead Ribbed (MLR) and Single-Lead Ribbed (SLR) tubing for the design of a vertical tube and spiral tube furnace sliding pressure once-through boiler. The location of each type of tubing in the furnace is determined based upon the heat transfer and flow characteristics for all loads at which the unit is expected to operate. This basically covers the range of loads from minimum load of approximately 25 to 30% of Maximum Continuous Rating (MCR) to MCR load. The novel furnace design consists of vertical smooth bore tubes in the low heat flux regions of the furnace and of a combination of vertical MLR and SLR tubes in the high heat flux areas, where necessary to avoid Departure from Nucleate Boiling (DNB) and/or Critical Heat Flux (CHF) and to meet tube metal temperature limitations. The length and the location of the MLR/SLR combination is adjusted for each panel to achieve optimum natural circulation characteristics. Since SLR tubes have higher flow resistance than MLR tubes or smooth tubes, their use must be minimized to locations where absolutely needed. Higher flow resistance has a tendency to reduce the desired natural circulation effect. But proper location and the correct proportion of the SLR and the MLR tubes around the furnace periphery will minimize the fluid and metal temperature difference between all membrane wall tubes at any elevation to stay below the allowable limit of 100 degrees F. at all loads. With natural circulation characteristics, the tubes in the furnace evaporator would have similar outlet temperatures in spite of the different heating characteristics of the vertical tube design. The actual design of the locations of each tubing type will be a function of the geometric size of the furnace, the kind and type of fuel, the load change requirements of the unit and the pressure and temperature requirements of the unit.

The application of this concept could be distinct for each panel in the furnace. The location of the SLR tubing in one panel could be in a different elevation, either higher or lower, than the panel adjacent to it.

U.S. Pat. No. 5,713,311 teaches a hybrid steam generating system. This system utilizes a typical furnace with a circulation system that can be used as a natural circulation system with recirculation during low load operation from 0 to ~25% load, a hybrid natural/once through circulation system from ~25% to 50% load, and once through circulation system from ~50% load to 100% load. The hybrid system allows for the unit to operate with natural circulation characteristics at low load and once through characteristics at higher loads. The system combines the operating principles of both the natural circulation drum boiler and once-through system.

U.S. Pat. No. 4,290,389 teaches a concept that is very similar to the concept given in FIGS. 2 and 3 of the prior art. The concept uses circulation pumps and orificing to achieve a sliding pressure once through boiler. The pumps are used for operation at lower loads and to satisfy the high pressure drop of the furnace orifices. The orificing is required for high pressure and high load operation.

Thermal-hydraulic problems are associated with the operational and design issues of once through boilers at reduced loads. These design issues are partially caused by the large variation in the furnace heat distribution and often require the use of orifices and/or circulation pumps to distribute the flow to the furnace circuits to correct the circulation problem. In many of the prior art designs, obtaining the necessary flow at low loads to adequately cool the furnace tubes required a much higher flow velocity than necessary at full load. Spiral tube furnace designs have also been used to minimize these effects of the heat absorption and load by properly selecting the furnace tube size and spiral angle to obtain an adequate furnace design. In both of the spiral and vertical tube boiler cases, high fluid velocities at full load were required to successfully design the unit for a typical load range from 35% to full load. The pressure drop associated with a furnace design with high velocities results in less efficient boiler design.

Other circulation design concerns with once through boilers occur at lower loads due to dynamic flow stability problems. Since the flow velocity is much lower at low loads, flow instability may occur which is undesirable for safe and reliable boiler operation. Correction of this problem has resulted in the orificing of each individual tube in the furnace. The orificing increases the pressure drop of the once through boiler design resulting in a less efficient boiler.

A recent design concept that has been developed by Siemens for a vertical tube furnace design requires the use of a special type of ribbed tube (optimized multi-ribbed tube) which will allow a lower mass velocity for the furnace design. However, the cost of this new ribbed tube is much greater than the normal type of ribbed tube. A design is needed in which the furnace tubing will only require standard MLR tubing.

A solution is needed for the issues with the higher and lower mass velocity types of once-through sliding pressure boilers. A design is needed so that special types of ribbed tubes are not required, thereby preventing an increase in the cost of the boiler. Also, a design is needed so that orificing or circulation pumps are not required.

SUMMARY OF INVENTION

It is an object of the present invention to provide a circulation system that allows a steam generator to be operated either as a natural circulation drum steam generator or a sliding pressure once-through steam generator, without orificing and circulation pumps.

It is another object of the invention to provide a design to overcome the start-up and low load operational problems associated with a regular once through boiler.

It is yet another object of the invention to accommodate the circulation requirements for the natural circulation drum operation below the critical point without penalizing the unit's overall boiler pressure drop when the boiler is in once-through operation at full load supercritical pressure It is a further object of the present invention to use the capabilities of a drumless natural circulation boiler, at operating pressures at or just below the critical pressure point and to operate above the critical pressure point as a once through boiler.

Accordingly, a steam generator circulation system is provided and includes a boiler feed pump, which pressurizes the system and provides the entire driving head to force water through an economizer, and through the waterwall tubes or vertical tubes of an evaporator (e.g., furnace). A separator receives a mixture of steam and water and sends the steam to a steam utilization unit such as a superheater. A valve is provided below the separator. If the valve is open, the saturated water from the separator is mixed with feedwater and recirculated through the tubes of the evaporator. If the valve is closed, recirculation is terminated. At loads below the critical point, the valve below the separator system would be open and the boiler would operate like a natural circulation drum boiler. At loads above the critical point, the valve below the separator system would be closed resulting in a boiler that operates like a once-through boiler.

One of the advantages of this invention is that the flow characteristics of a natural circulation drum type of boiler can be utilized at low loads without the need of a circulation pump and/or orificing. The location of the valves is critical in this design for natural recirculation without using circulation pumps due to the extra pumping head that is generated by increasing the density of water at high elevations in the downcomer system. This allows for an optimized vertical tube furnace that provides the appropriate velocities across the operating load range and gives increased capability for on-off cycling, rapid load change, superior low load protection with a true natural circulation design, and lower overall furnace pressure drop than a spiral design. The present invention will not be velocity limited and therefore will provide adequate circulation across the whole load range. The present invention overcomes the issues with the higher and lower mass velocity types of once-through sliding pressure boilers. The furnace tubing for this invention will only require standard MLR tubing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
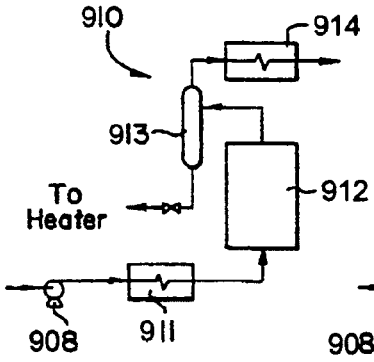
FIG.1 PRIOR ART
FIG. 1 is a schematic view illustrating one known once-through boiler system.
Figure 2:
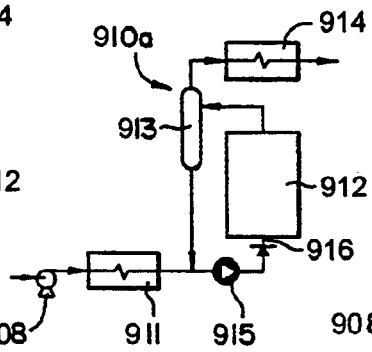
FIG.2 PRIOR ART
FIG. 2 is a schematic view illustrating a second known once-through boiler.
Figure 3:
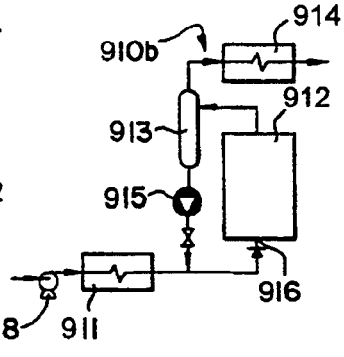
FIG.3 PRIOR ART
FIG. 3 is a schematic view illustrating a third known once-through boiler.
Figure 4:
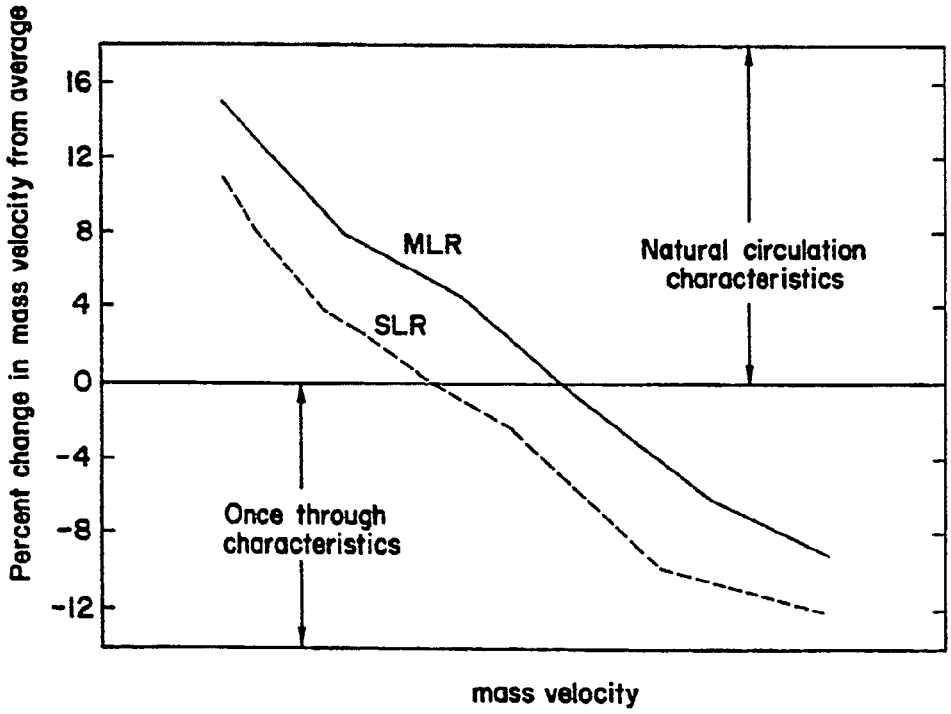
FIG. 4 is a graph plotting changes in mass velocity characteristics for vertical furnace tubing.
Figure 5:
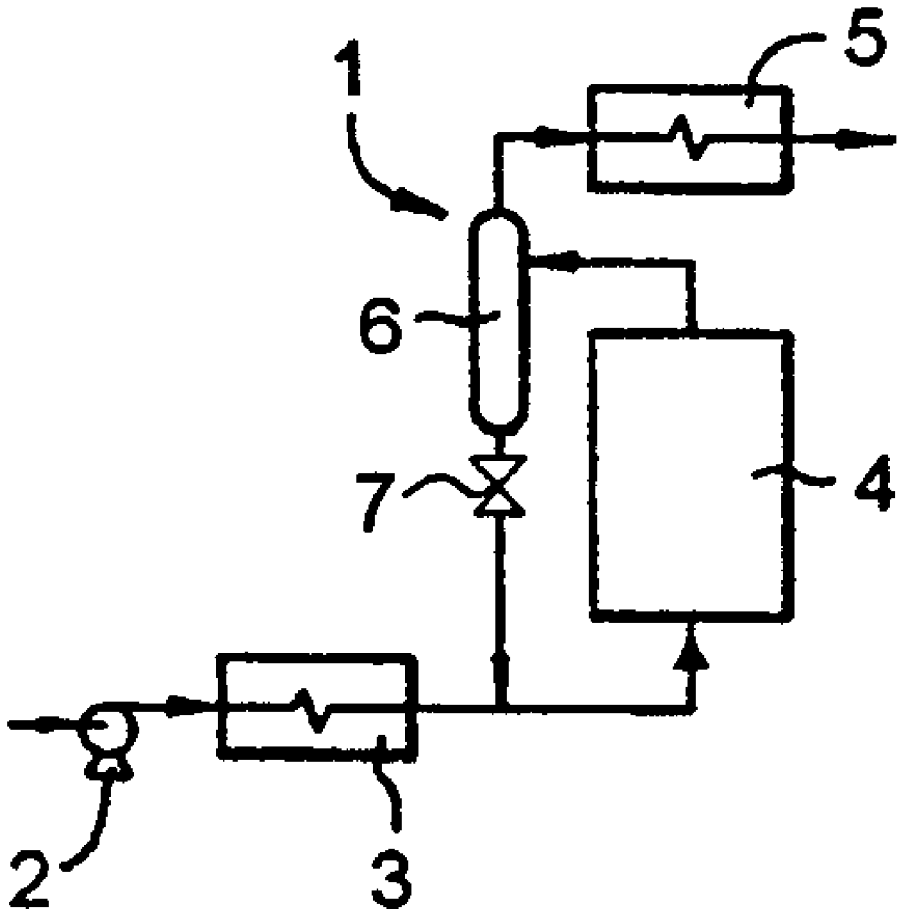
FIG. 5 is a schematic view illustrating a boiler system having either a once-through circulation mode or a natural circulation drum mode.

Referring now to the drawings, in which like reference numerals are used to refer to the same or similar elements, FIG. 5 shows a circulation system 1 that can be used to operate a steam generator as either a natural circulation steam generator or a sliding pressure once-through steam generator, but only one of these types of circulation systems at a time.

A boiler feed pump 2 pressurizes the system 1 and provides the entire driving head to force water through an economizer 3 for supplying heated water to the waterwall tubes of an evaporator 4 (e.g., a furnace). Preferably, the evaporator 4 has a vertical tube design. A first conduit, or system of conduits, leads from the outlet of the economizer 3 to the vertical waterwall tubes. A plurality of inlet headers (not shown) connect the end of the first conduit to the lower end of the waterwall tubes for conveying the heated water from the conduit to the waterwall tubes.

The system 1 further includes a steam utilization unit such as a superheater 5 which can be used in conjunction with a steam separator 6. The steam separator 6 receives effluent from the tubes via a plurality of outlet headers (not shown) connecting the upper end of the vertical waterwall tubes to a second conduit, or system of conduits, such as a riser for example, which leads to the steam separator 6. A third conduit, or system of conduits, such as for example a discharge pipe and/or a downcomer, connects the separator 6 to the vertical waterwall tubes of the evaporator 4. A valve 7 is provided along the third conduit leaving the separator 6. If the valve is open, water is partially recirculated from the separator 6 to the furnace waterwall tubes via the third conduit and first conduit. The valve 7 is operable by means which respond to various load conditions and other parameters, in a conventional manner. Once the steam separator 6 receives the effluent from the vertical waterwall tubes via the second conduit, it sends steam to the superheater 5, via a fourth conduit, or system of conduits.

In operation at pressures at or just below the critical pressure point where the load is low, or below the critical point, the circulation system 1 operates a steam generator as a natural circulation drum unit. To this end, the valve 7 is open and water flows from the economizer 3 and mixes with the water from the downcomer system then the mixture flows to the vertical waterwall tubes of the evaporator 4 where it is heated from a temperature below saturated water conditions to form a two-phase mixture. The mixture is collected in the waterwall tubes and is routed to the separator 6. The separator 6 is designed for the full design pressure of the high pressure circuitry, and functions to separate the two-phase mixture into saturated water and steam at these low loads. The steam leaving the separator 6 is routed for passage onto one or more downstream heat utilization units, such as superheater 5. The separated saturated water discharging from the separator 6 passes through the third conduit (e.g., a downcomer for example). The valve is preferably higher up in the third conduit and near the separator 6 so that the feed system provides more pumping head for operation during natural circulation drum mode. Because the valve 7 is open, the separated saturated water mixes with the water from the economizer 3 before being passed to the inlet headers for recirculation through the vertical waterwall tubes. During this operation, the water flow from the economizer 3 is regulated in a manner to maintain a water level in the separator 6 sufficient to ensure this recirculation of water from the separator. The flow rate of the recirculated water flow from the separator 6 is governed by the heat absorption of the furnace waterwalls and the sizing of the conduits.

In operation at pressures above the critical pressure point where the load is high, or above the critical point, the circulation system 1 operates a steam generator as a once-through steam generator. To this end, the valve 7 is closed, terminating recirculation of the saturated water from the separator 6 to the inlet headers for the vertical waterwall tubes of the evaporator 4. Thus, the water level in the separator 6 is not controlled at high loads and there is no recirculated flow of the water from the separator back to the waterwalls of the furnace 4. The water flow rate controls the temperature of the steam output. Thus, this phase of the operation is essentially the same as that for a once-through system.

Another embodiment of the invention is shown in FIGS. 6-10. The system 100 comprises a separator 112, downcomers (DC's) 14 provided with downcomer bottles (DCB's) 15 at a lower end thereof, supply tubes 16, a furnace 28, furnace wall tubes 18, and riser tubes 20. System 100 is drumless, and shares a similar separator structure to the drumless natural circulation boiler described in U.S. Pat. No. 6,336,429, which is incorporated by reference. The general functionality, operating conditions, advantages, and disadvantages of natural circulation boilers with and without drums are described in more detail in U.S. Pat. No. 6,336,429.

A plurality of inlet headers 26 connect the end of the supply tubes 16 to the lower end of the tubes 18. A plurality of outlet headers 30 connect the upper end of the tubes 18 to the risers 20 and separator 112. A boiler feed pump 13 is provided for pressurizing the system and providing the entire driving head to force water from the downcomer 14 to the furnace wall tubes 18 of furnace 28 in once-through mode, which will be described in more detail below. An economizer 12 is provided for heating the water entering the downcomer 14. As soon as the heated water in the tubes 18 reaches saturated conditions, steam begins to form and the water within the wall tubes 18 becomes a two-phase mixture. The steam/water mixture eventually reaches outlet headers 30, from where the steam/water mixture is conveyed to the separator 112.

The system 100 further includes a steam utilization unit such as a superheater 34 which can be used in conjunction with a steam separator 112. For this embodiment, separator 112 is responsible for phase separation of the steam/water mixture instead of a conventional steam drum. Once the steam separator 112 receives the two-phase steam/water mixture or effluent from the vertical tubes 18, it separates the two phases of the mixture and sends steam to the superheater 34. A valve 21 is provided along the downcomer 14, and preferably near the top of the downcomer 14 near the steam separator 112 for providing more pumping head for operation during natural circulation mode, which is described in more detail below. If the valve 21 is open, the saturated water from the mixture is mixed with feedwater 24 and partially recirculated from the separator 112 to the furnace tubes 18 via downcomer 14. The valve 21 is operable by means which respond to various load conditions and other parameters, in a conventional manner.

Figure 6:
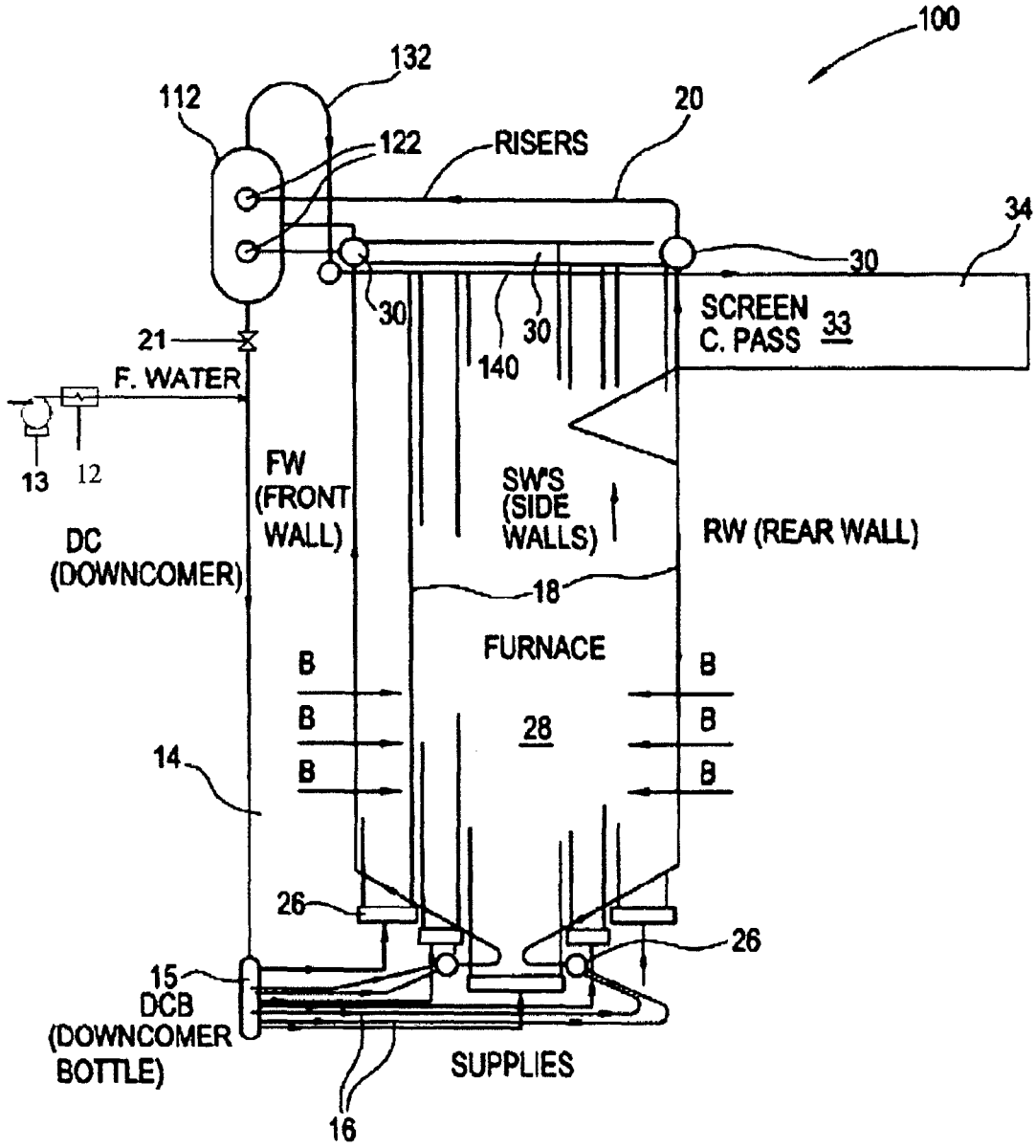
FIG. 6 is a schematic view of a drumless boiler containing a valve for allowing either a once-through circulation mode or a natural circulation drum mode.
Figure 7:
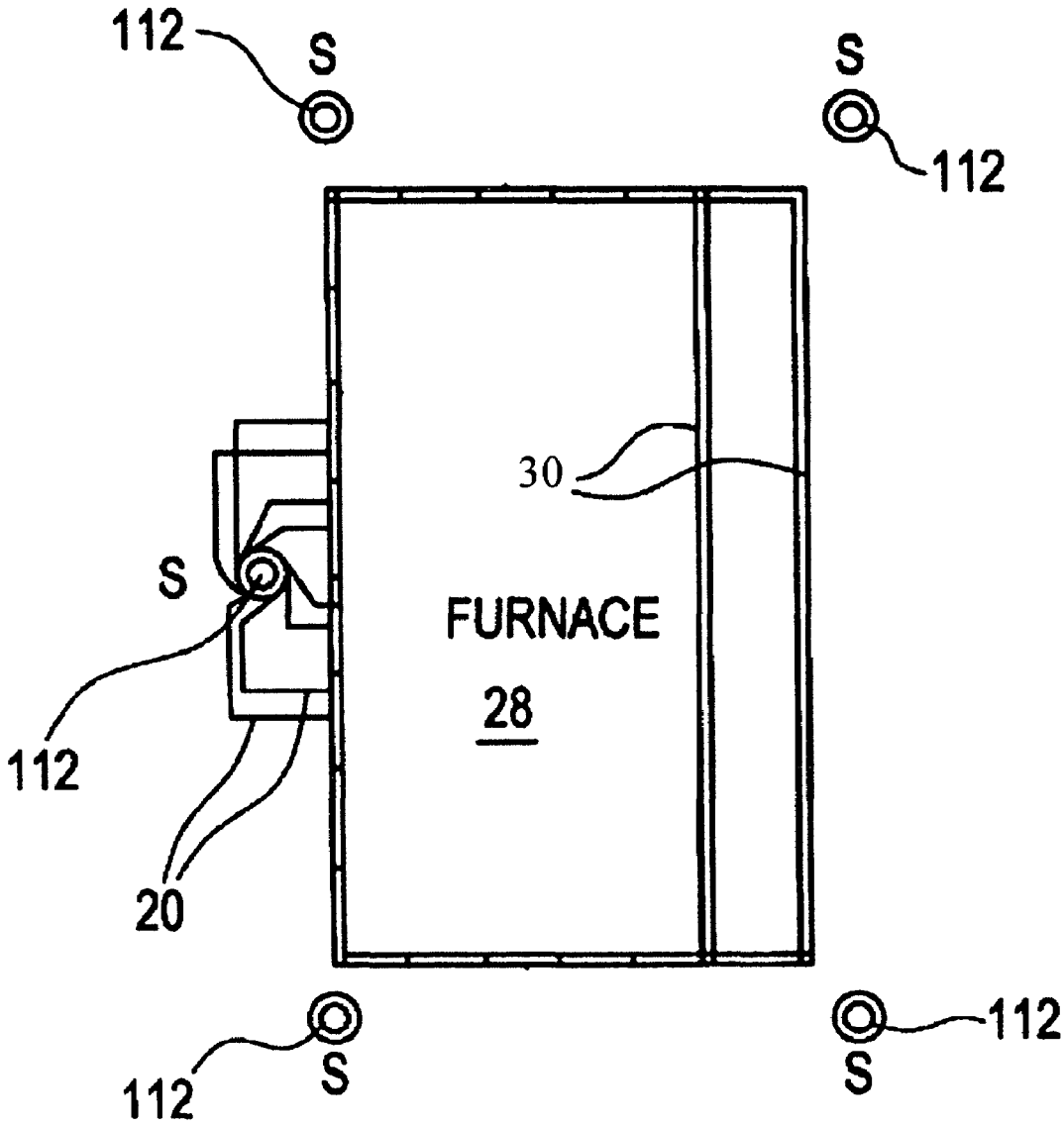
FIG. 7 is a top view of the drumless boiler of FIG. 6, illustrating how the vertical steam/water separators may be located around a periphery of the furnace.
Figure 8:
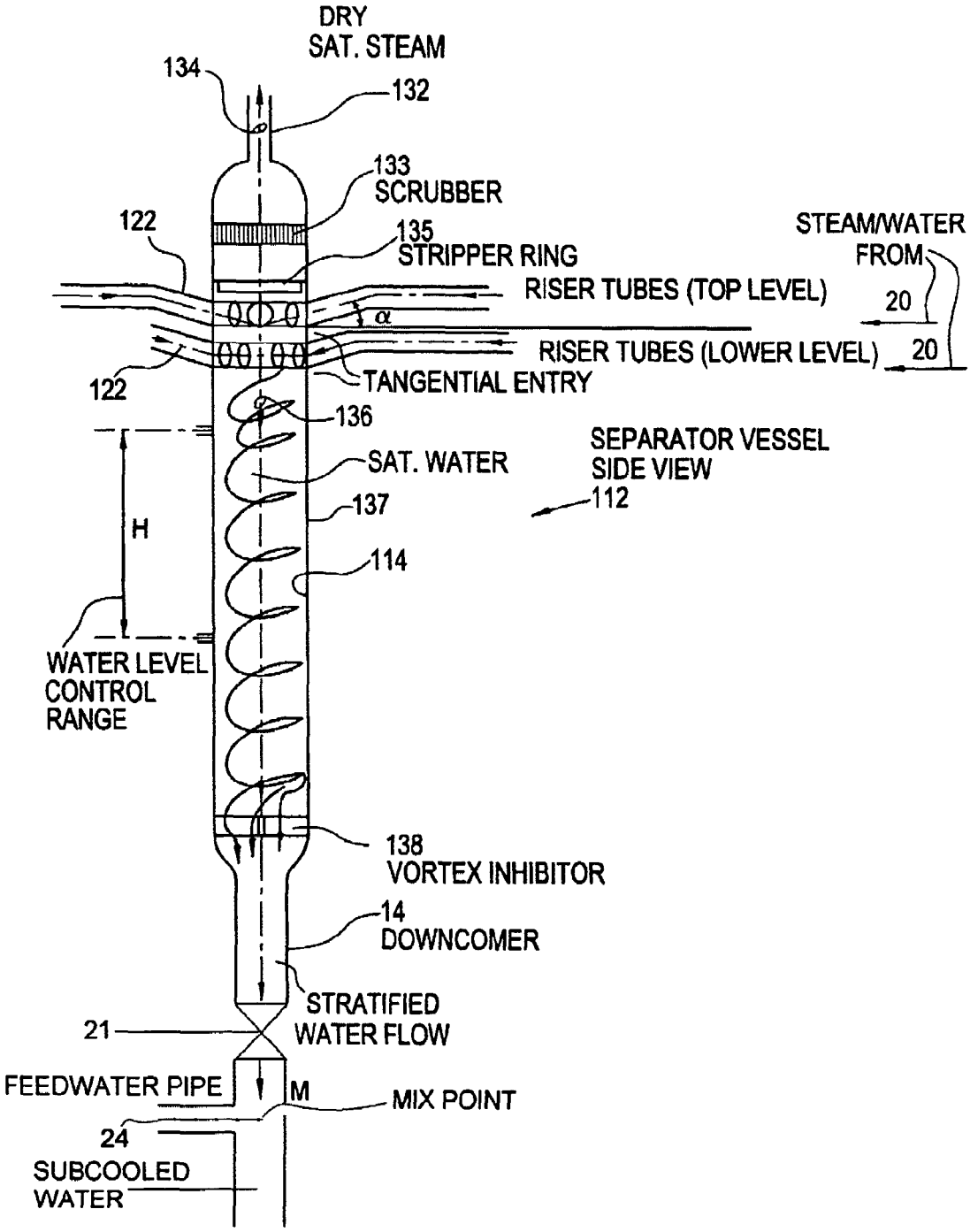
FIG. 8 is a sectional side view of one embodiment of a vertical steam/water separator and a valve below the separator for allowing either a once-through circulation mode or a natural circulation drum mode.

As shown in FIGS. 6, 7 and 8 in particular, phase separation is achieved through a suitable number of tangential nozzles 122 which lead the steam-water mixture from the riser tubes 20 into the separators 112 where the saturated steam is separated from the steam-water mixture by centrifugal action along the cylindrical inside periphery 114 of the separator vessels 112. The nozzles must be suitably inclined against the horizontal plane to avoid interference between the multiple fluid jets. The angle of inclination, ∀, is preferably 15 degrees, but the actual value may be adjusted in certain circumstances. The tangential velocity is a function of the total flow to each separator 112, the boiler pressure, the number and size of the nozzles 122, the allowable pressure drop across the separators 112, and the inside diameter of the separators 112 and must be sufficient to effect separation, like in other types of separators.

The separator design is conceptually shown in FIG. 8. While in each separator 112, saturated steam 134 leaves through connections 132 at the top of the separator 112, as illustrated in FIGS. 6 and 8, while the separated, saturated water 136 flows downward to a lower portion of the steam/water separator 112 and is in rotation imparted through the centrifugal action at the top. The saturated steam 134 preferably passes through a scrubber element 133 at the upper portion of the separator 112 to ensure as dry saturated steam as possible; a stripper ring 135 may also be employed in the upper portion of the separator 112 to prevent water swirling around the inside perimeter 114 of the walls 137 of the separator 112 from being entrained in the exiting saturated steam 134. The saturated water leaves the separator 112 through vortex inhibitors 138, such as baffles. Feedwater 24 provided via one or more conduits enters the downcomer 14 and mixes with the saturated water at a mix point or region M. Due to the smaller water inventory in the separator 112, compared with that in a conventional single steam drum, the water level control range H in the separators 112 must be over a much greater height difference than in a conventional drum (e.g., ∀6 feet compared with typically ∀6 inches).

As illustrated in FIG. 7, it will be seen that the vertical steam/water separators 112 according to the present invention may be easily located around the perimeter of the furnace 28. This permits the lengths of individual supply tubes and riser tubes 20 to be optimized or routed to avoid interference with existing structural steel or other equipment associated with the steam generator 100. This flexibility becomes extremely important in situations where major steam generator repairs, modifications, or conversions are being contemplated.

Figure 9:
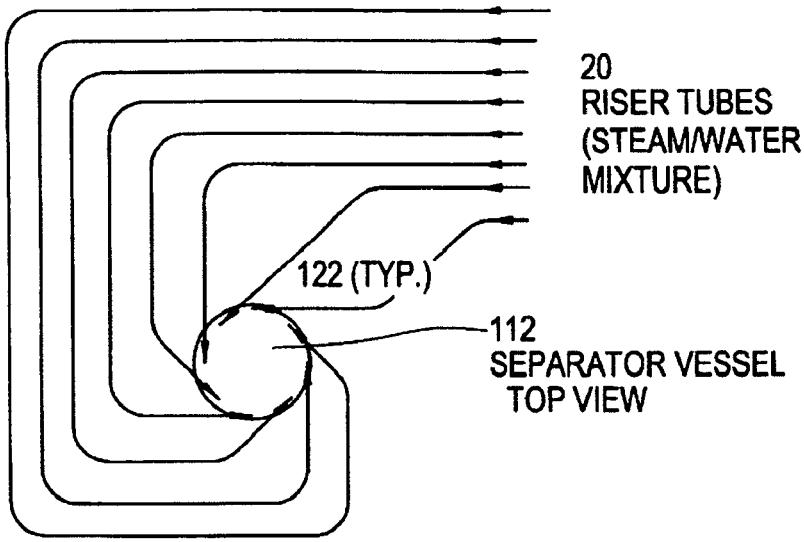
FIG. 9 is a schematic plan view of an individual vertical steam/water separator and how riser tubes connected thereto might be arranged.
Figure 10:
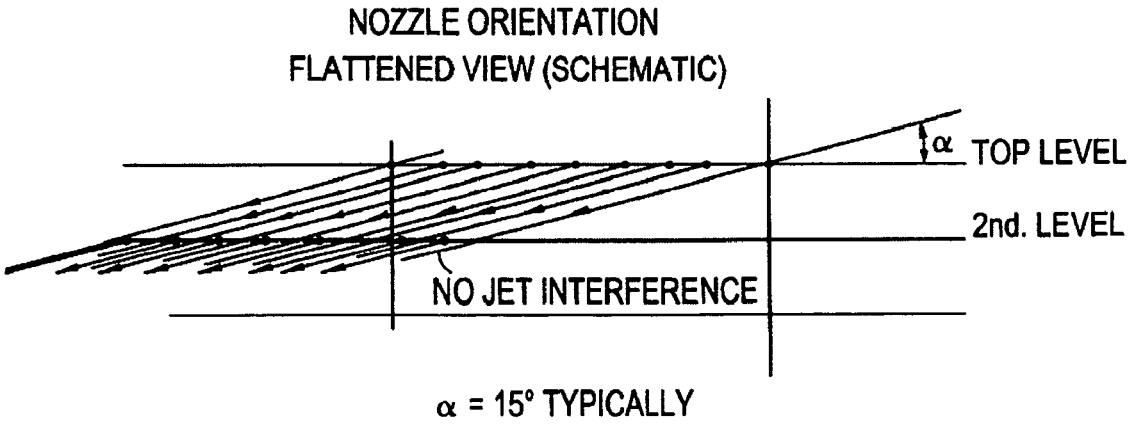
FIG. 10 is a schematic, flattened view of the outside perimeter of the vertical steam/water separator of FIG. 9, illustrating how the riser tubes in one level are oriented and staggered with respect to riser tubes in an adjacent level.

Returning now to FIG. 8, and next to FIGS. 9 and 10, the steam/water separator 112 is of a compact, efficient design. The steam/water mixture enters near the top of the separator vessel 112 through the riser tubes 20 through a plurality of nozzles 122, which are tangentially arranged around the periphery of the vessel 112, at one or possibly more levels (FIG. 9). The tangential entry is designed to create the formation of a rotating vortex of the steam/water mixture. The rotating vortex provides the centrifugal force needed to separate the steam from the water. FIG. 9 shows a top view of a vertical separator 112 and the tangential entry of riser nozzles 122 into the vessel 112. The nozzles 122 are inclined downward (typically 15 degrees) to use gravity which promotes the water flow downwards. This inclination also avoids interference between the jets coming from the plurality of nozzles 122. If more than one level of nozzles 122 is required, it becomes imperative to avoid interference between the jets from the various levels. This can be achieved through proper staggering of the nozzle 122 locations at different levels, as indicated in FIG. 10, which is a schematic, flattened view of the outside perimeter of the vertical steam/water separator 112 of FIG. 9 illustrating how the nozzles 122 for riser tubes 20 in one level are oriented and staggered with respect to the nozzles 122 for riser tubes 20 in an adjacent level. While two levels are illustrated, it is possible to have fewer or greater numbers of levels. The number depends upon a combination of factors, some being functional in nature such as the amount of steam/water mixture being delivered to a given separator 112, others being structural in nature, such as the wall thickness and efficiency of the ligaments between adjacent nozzle penetrations on a given separator 112. This also forces the optimal separation of steam from the water through centrifugal action along the vessel inside wall.

The steam, which is at saturation condition, i.e., dry, but not superheated, is driven upward by the stripper ring 135 and through a torturous path (e.g., corrugated plate array) scrubber 133 which removes practically all residual moisture and droplets. Essentially dry, saturated steam 134 flows out from the separator 112 through one or more nozzles 132 (saturated steam connections) at the top of the separator 112. These saturated steam connections 132, in turn, convey the saturated steam 134 to the various steam-cooled circuits, like the boiler roof tubes 140, convection pass side wall enclosures 33, before being superheated to the final steam temperature in the various superheater stages 34, from where it flows to the high pressure turbine.

The saturated water 136, on the other hand, flows along the inner surface 114 of the separator 112, forming a vortex that flows primarily in a downward direction. With the formation of the vortex, a small portion of the water will move up the inner surface 114 of the separator 112 to the stripper ring 135. The stripper ring 135 is used to contain the upward movement of the water 136 from reaching scrubber 133. There is still rotation due to the tangential motion of the saturated water imparted by the nozzles 122. A vortex inhibitor 138 at the bottom of the vessel 112 prevents this rotation to continue as the water flows into and down through the downcomer 14. A rotating fluid column could cause maldistribution of flow to the various furnace circuits connected to the downcomer 14 and limit the fluid transfer capability of the downcomer 14.

In operation at pressures at or just below the critical pressure point where the load is low, or below the critical point, the circulation system 100 operates a steam generator as a natural circulation drum unit. To this end, the valve 21 is open and the water flows from the economizer 12, mixes with water from the downcomer system, and the mixture flows to the vertical tubes 18 of the furnace 28 where it is heated from a temperature below saturated water conditions to form a two-phase mixture. The mixture is collected in the tubes 18 and is routed to the separator 112. The separator 112 functions to separate the two-phase mixture into a saturated water stream and a steam stream at these low loads. The stream of steam leaving the separator 112 passes onto the superheater 34. The separated saturated water discharging from the separator 112 passes through the downcomer 14. The valve is preferably near the separator 112 and higher up in the downcomer 14 so that the feed system provides more pumping head for operation during natural circulation mode. Because the valve 21 is open, the separated saturated water mixes with the water from the economizer 12 before being passed to the inlet headers 26 for recirculation through the vertical wall tubes 18. During this operation, the water flow is regulated in a manner to maintain a water level in the separator 112 sufficient to ensure this recirculation of water from the separator. The flow rate of the recirculated water flow from the separator 112 is governed by the heat absorption of the furnace walls 18, the sizing of the downcomer 14 leaving the separator 112, and the sizing and quantity of the supplies 16 and risers 20.

In operation at pressures above the critical pressure point where the load is high, or above the critical point, the circulation system 100 operates a steam generator as a once-through steam generator. To this end, the valve 21 is closed, terminating recirculation of the saturated water from the separator 112 to the inlet headers 26 for the vertical wall tubes 18 of the furnace 28. Thus, the water level in the separator 112 is not controlled at high loads and there is no recirculated flow of the water from the separator 112 back to the furnace walls 18. The water flow rate controls the temperature of the steam output. Thus, this phase of the operation is essentially the same as that for a once-through system.

Figure 11:
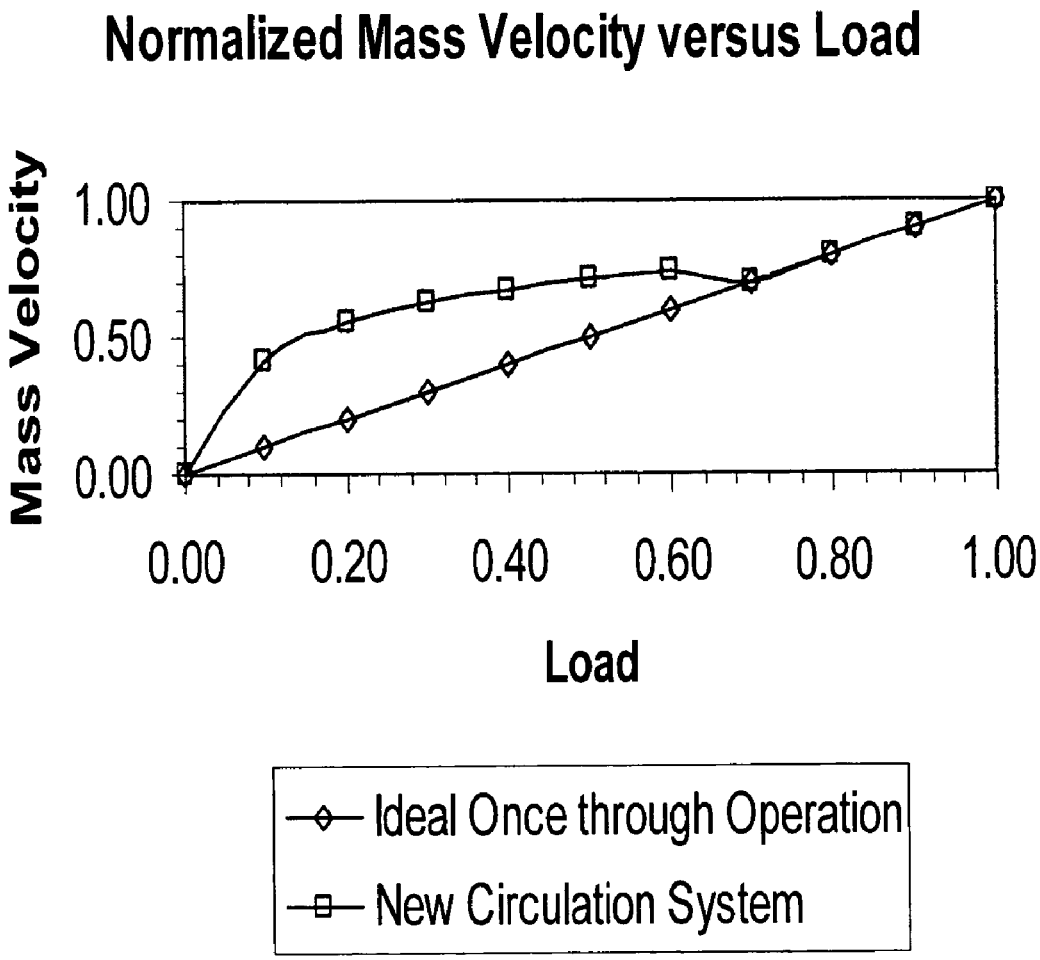
FIG. 11 is a graph plotting the effect of mass velocity versus load for a typical sliding pressure application.

Thus, this embodiment of the invention allows use of the capabilities of a drumless natural circulation boiler, at operating pressures at or just below the critical pressure point, and through use of a valve below the vertical separator, to allow the boiler to operate above the critical pressure point as a once-through boiler. This provides design flexibility to overcome the start-up and low load operational problems associated with a regular once-through boiler. By locating the vertical separator(s) in the front of the boiler, the appropriate number of separators can be sized to accommodate the circulation requirements for the natural circulation operation below the critical point without the penalty of the unit's overall boiler pressure drop when the boiler is in once-through operation at full load supercritical pressure. By properly sizing the furnace tube size, the boiler operates at higher than typical once-through flow velocities at loads below the critical point and would have optimum design velocities when operating at the pressures above the critical pressure point. The design allows for sliding pressure operation. In FIG. 11, the effect of mass velocity versus load is given for a typical sliding pressure application. It is noted that critical point pressure would occur at about 75% of full load for this example. The higher mass velocity below the critical point provides a circulation ratio of total furnace flow to generated steam flow that is greater than 1; therefore a greater circulation design margin can exist at loads below the critical point. In this mode of operation, the boiler operates like a natural circulation drum boiler. At loads above the critical point, the valve in the separator system is closed resulting in a boiler that operates like a once-through boiler.

While a specific embodiment of the invention has been shown and described in detail to illustrate the application of the principles of the invention, it will be understood that the invention may be embodied otherwise without departing from such principles.

What is claimed is:

1. A steam generating system comprising:

a furnace with walls formed by non-orificed vertical tubes having an inlet and outlet;

feed pump means for pressurizing said system to force water into the inlets of the tubes via at least one first conduit for passage to the vertical tubes to transfer heat from the furnace to the water to convert a portion of the water to steam forming a steam-water mixture;

a valveless unbypassed second conduit for transferring the heated steam-water mixture to a separator for separating said steam from said water, wherein the separator comprises a stripper ring and a scrubber;

a third conduit for connecting the separator to the inlets of the vertical tubes for transferring separated saturated water from the separator to the inlets of the tubes for recirculation; and a on/off control valve along the third conduit and downstream of the separator for controlling boiler circulation mode and passage of water from the separator to the inlets of the vertical tubes, an unbypassed feed water inlet conduit attached to the third conduit downstream of the control valve, wherein the feed pump means is located along the feed water conduit; and wherein the system is operable with only one type of circulation system depending on load operation, the separator is unbypassed at all load operations, and the third conduit does not possess a circulation pump.

2. A steam generating system according to claim 1, wherein the system is operable only as a natural circulation system during low load operation.

3. A steam generating system according to claim 1, wherein the system is operable only as a once-through circulation system during high load operation.

4. A steam generating system according to claim 1, wherein the valve is open if the load is low, permitting recirculation through the vertical waterwall tubes.

5. A steam generating system according to claim 4, wherein separated saturated water from the separator mixes with feedwater before recirculation.

6. A steam generating system according to claim 4, wherein the water flow is regulated in a manner to maintain a water level in the separator sufficient to ensure recirculation of water from the separator.

7. A steam generating system according to claim 1, wherein the valve is closed if the load is high, terminating recirculation of the water from the separator to the vertical tubes of the furnace.

8. A steam generating system according to claim 1, further comprising at least one fourth conduit for transporting said steam, separated in said separator, to a superheater.

9. A steam generating system comprising:

a furnace with walls formed by non-orificed vertical tubes having an inlet and outlet;

pump means for pressurizing said system to force water into the inlets of the tubes via at least one first conduit for passage to the vertical tubes to transfer heat from the furnace to the water to convert a portion of the water to steam forming a steam-water mixture;

a vertical separator;

unbypassed valveless riser means connected between the vertical tubes and the vertical separator for returning a steam/water mixture to the separator, the riser means being connected to the vertical separator at an inclined tangential angle for swirling the steam/water mixture in the vertical separator for separating steam from water in the vertical separator, and wherein the separator comprises a stripper ring and a scrubber element;

saturated steam connector means connected to the separator for conveying saturated steam therefrom;

at least one downcomer for connecting the separator to the inlets of the vertical tubes for transferring separated saturated water from the separator to the inlets of the tubes for recirculation; and a on/off control valve located along the downcomer, and close to the separator, for controlling boiler circulation mode and passage of water from the separator to the inlets of the vertical tubes;

a feed water inlet conduit attached to the downcomer downstream of the control valve; wherein the downcomer is unbypassed and the feed water inlet conduit is the only means of introducing fresh feed water into the system, and wherein the system is operable with only one type of circulation system depending on load operation, and the separator is unbypassed at all load operations.

10. A steam generating system according to claim 9, wherein said at least one vertical separator includes an array of the scrubber elements vertically oriented around an inside perimeter of the separator, and wherein the riser means are the only inlets in fluid communication with the separator.

11. A steam generating system according to claim 10, wherein the individual scrubber elements are spaced from an inside surface of a wall of the separator so as to create a substantially open annular region therebetween.

12. A steam generating system according to claim 10, further comprising tangential nozzle means connected to the separator below the array of vertically oriented scrubber elements for receiving the steam/water mixture from the riser means.

13. A steam generating system according to claim 9, wherein the system is operable only as a natural circulation system during low load operation.

14. A steam generating system according to claim 9, wherein the system is operable only as a once-through circulation system during high load operation.

15. A steam generating system according to claim 9, wherein the valve is open if the load is low, permitting recirculation through the vertical waterwall tubes.

16. A steam generating system according to claim 15, wherein separated saturated water from the separator mixes with feedwater before recirculation.

17. A steam generating system according to claim 15, wherein the water flow is regulated in a manner to maintain a water level in the separator sufficient to ensure recirculation of water from the separator.

18. A steam generating system according to claim 9, wherein the valve is closed if the load is high, terminating recirculation of the water from the separator to the vertical tubes of the furnace.

19. A steam generating system according to claim 9, wherein said saturated steam connector means transport said steam to a superheater.

* * * * *